US006780019B1

(12) United States Patent
Ghosh et al.

(10) Patent No.: US 6,780,019 B1
(45) Date of Patent: Aug. 24, 2004

(54) PEN-BASED COMPUTING SYSTEM WITH A RELEASABLE SOCKET CONNECTOR FOR CONNECTING A BASE UNIT TO A TABLET UNIT

(75) Inventors: Prosenjit Ghosh, Portland, OR (US); Shreekant Suryakant Thakkar, Portland, OR (US); Truong V. Phan, Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/367,364

(22) Filed: Feb. 14, 2003

(51) Int. Cl.[7] ..... H01R 39/00; G09G 5/00

(52) U.S. Cl. ..... 439/31; 345/173

(58) Field of Search ..... 439/31, 12, 11, 439/13, 165; 345/173

(56) References Cited

U.S. PATENT DOCUMENTS

| | | | | | |
|---|---|---|---|---|---|
| 5,494,447 | A | * | 2/1996 | Zaidan | 439/31 |
| 5,619,397 | A | * | 4/1997 | Honda et al. | 361/686 |
| 5,867,148 | A | * | 2/1999 | Kamimaki et al. | 345/169 |
| 6,532,146 | B1 | * | 3/2003 | Duquette | 361/681 |
| 2003/0080949 | A1 | * | 5/2003 | Ditzik | 345/173 |
| 2004/0043650 | A1 | * | 3/2004 | Yang et al. | 439/165 |

* cited by examiner

*Primary Examiner*—Chandrika Prasad
(74) *Attorney, Agent, or Firm*—Blakely, Sokoloff, Taylor & Zafman LLP

(57) ABSTRACT

In one embodiment the invention provides a pen-based computing system. The system comprises a tablet unit including a display screen and an input port; a base unit including first and second generally planar members connected via a hinge, a keyboard supported on the first planar member, a socket connector disposed on the second planar member, electrical lines to carry signals from the keyboard to the socket connector; and a releasable locking mechanism to releaseably lock the socket connector to the input port.

19 Claims, 5 Drawing Sheets

PEN-BASED COMPUTING SYSTEM WITH A RELEASABLE SOCKET CONNECTOR FOR CONNECTING A BASE UNIT TO A TABLET UNIT

FIELD OF THE INVENTION

This invention relates to mobile computing devices. In particular it relates to a pen-based mobile computing device.

BACKGROUND

Pen-based computing systems, unlike conventional laptop or notebook computers, allow data input via a stylus or pen. Briefly, a pen is used to write characters on a portion of the display screen that includes a digitizer. The digitizer captures the characters and handwriting recognition software converts the characters into recognized text.

In addition to allowing pen-based data input, some pen-based computing systems also support keyboard-based data entry using a conventional keyboard.

The pen and keyboard based data entry methods ideally require the display screens to have two operative positions. In a first operative position, the display screen is required to be held or supported in a generally horizontal orientation to allow for pen-based data input. In a second operative position, the display screen is required to be held at an angle relative to the horizontal to allow for data entry via the keyboard.

In one pen-based computing system, a tablet unit comprising a processing component and a display screen, and a base unit that houses the keyboard are permanently secured together via a hinge. The display screen may be operated like a conventional laptop screen if a keyboard is to be used. Alternatively, the display screen may be rotated 180 degrees and pivoted towards the base unit so that an underside thereof rests on the base unit, in which position the pen may be used for data entry.

However, this system requires the tablet unit and the base unit to be permanently secured together. Thus, the base unit may not be separated from the tablet unit, for example, when only the tablet unit is required during pen-based data entry. This is undesirable since the presence of the base unit makes the system unnecessarily bulky if only the tablet unit is being used during pen-based data entry.

DETAILED DESCRIPTION

Figures 1A, 1B, 1C, 1D, 1E:
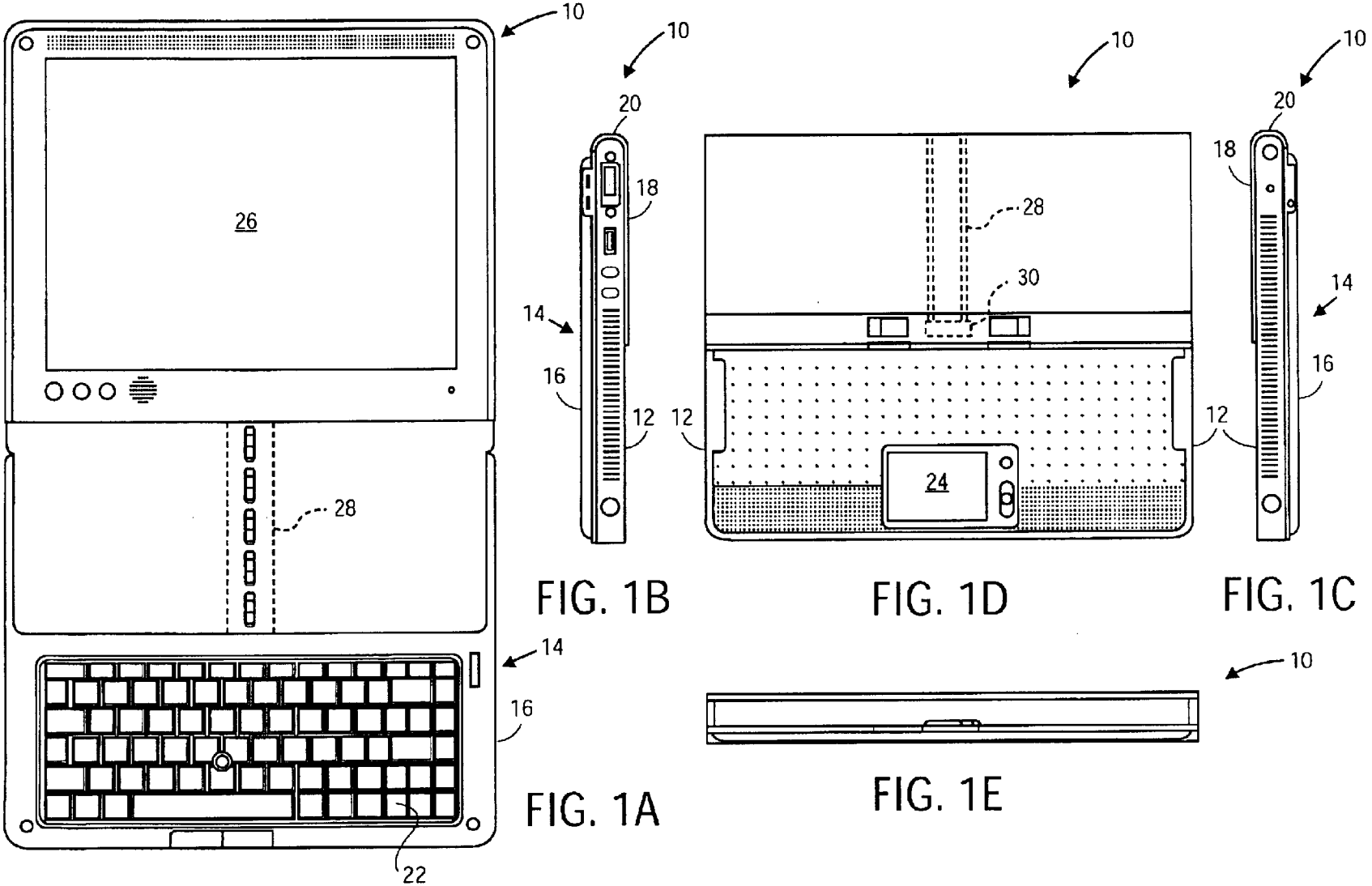
FIGS. 1A to 1E show various views of a computing system in accordance with one embodiment of the invention.

In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

FIGS. 1A to 1E of the drawings show various views of a system 10 in accordance with one embodiment of the present invention. The system 10 is a pen-based computing system and comprises a tablet unit 12 and a base unit 14.

The base unit 14 comprises two generally flat panels 16, and 18 which are interconnected by a flexible hinge 20. The hinge 20 permits articulation of the panel 18 relative to the first panel 16. A keyboard 22 is supported on the first panel 16 and is used to enter data into the tablet unit 12 when the system 10 is operated in a laptop mode.

The tablet unit 12 includes a housing or enclosure which houses electronic components, such as various processing and memory modules mounted on a substrate, e.g., a motherboard. In addition, the enclosure houses a mini-screen 24, which in one embodiment may be a liquid crystal display (LCD) screen which provides information such as email and calendaring information to a user. In addition, the enclosure houses a large screen 26 which coupled with a digitizer (not shown). In use, a pen or stylus is used to write characters directly on a portion of the screen 26. The digitizer converts the writing into an electronic signal, and handwriting recognition software converts the electronic signal into an input character.

The system 10 has a carry mode configuration in which the tablet unit 12 is supported on the first panel 16 of the base unit 14, and the second panel 18 of the base unit 14 is supported on the tablet unit 12. The carry mode configuration is illustrated in FIGS. 1B, 1C, and 1D of the drawings.

In one embodiment, the second panel 18 of the base unit 14 may be releaseably locked to the tablet unit 12 when in the carry mode configuration as will be explained in greater detail below.

Figure 2:
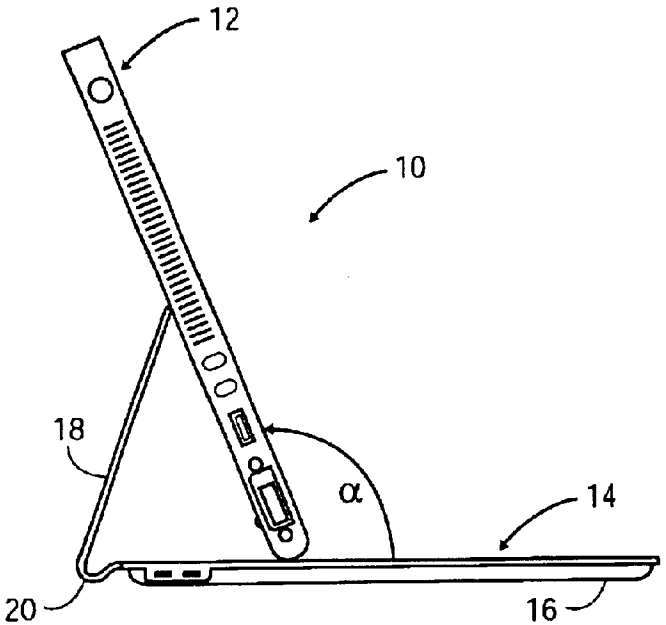
FIG. 2 shows a side view of the system of FIGS. 1A to 1E, in a laptop mode configuration.

FIG. 2 of the drawings shows a side view of the system 10 when in a laptop mode configuration. In the laptop mode configuration, data entry is primarily via the keyboard 22. Accordingly, the tablet unit 12 is held at an inclined position relative to the keyboard 22 so that the tablet unit 12 makes an angle $\alpha$ of greater than 90 degrees with the keyboard 22. In this position, the second panel 18 of the base unit 14 is used as a prop to support the tablet unit 12 as can be seen in FIG. 2.

Figure 3A:
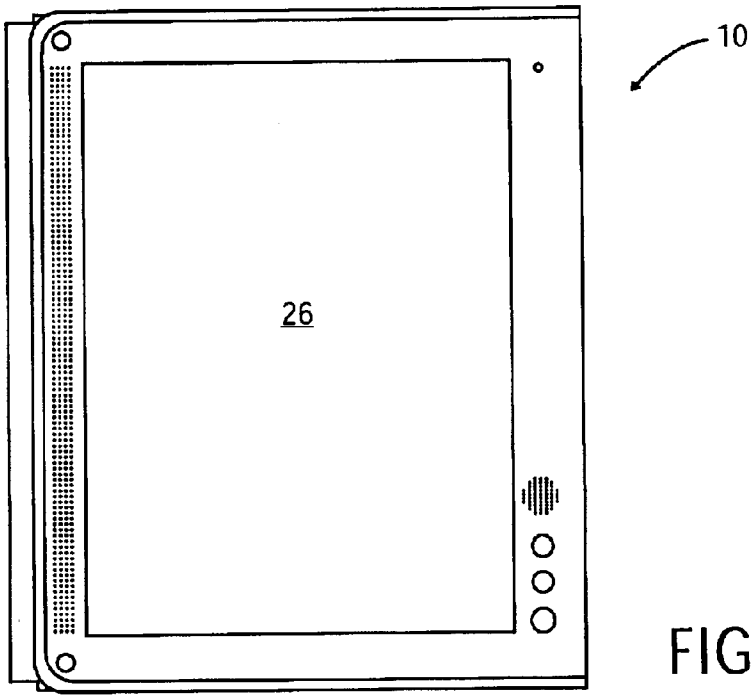
FIGS. 3A and 3B show a top plan view, and a side view, respectively of the system of FIGS. 1A to 1E while in a tablet mode configuration.
Figure 3B:
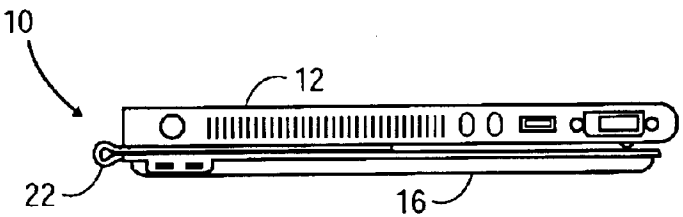

FIGS. 3A and 3B of the drawings show the system 10 when in a tablet mode configuration. Briefly, when in the tablet mode configuration, the tablet unit 12 of the system 10 is placed directly over the base unit 14 which is in a folded condition in which the second panel 18 bears against the first panel 16. In the tablet mode configuration, the display screen 26 is exposed to a user who may input text into the system 10 by writing directly on the screen 26 using the digital pen or stylus, in the manner described above.

Figure 4:
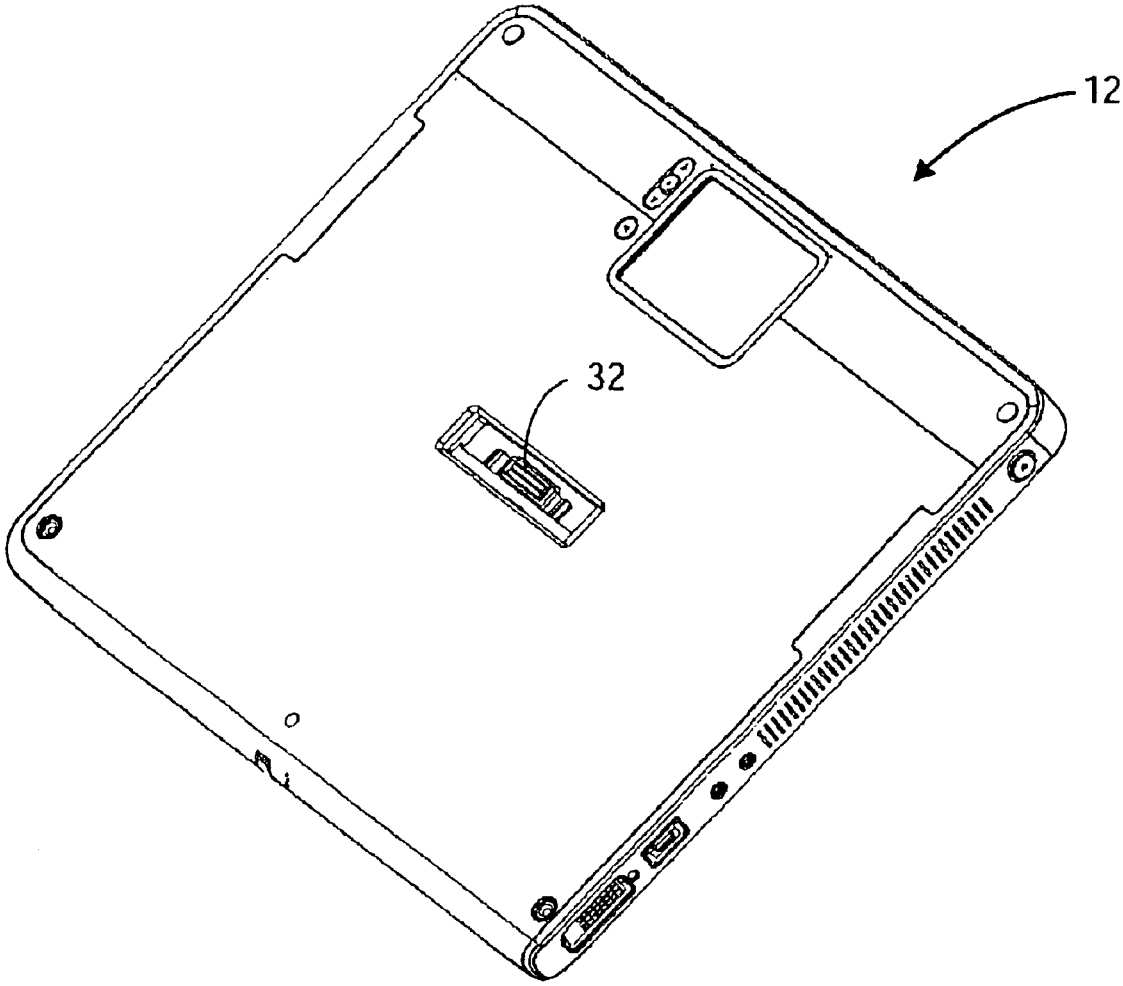
FIG. 4 shows a perspective view of a tablet unit of the system of FIGS. 1A to 1E.

As noted above, when in the tablet mode configuration, data input is primarily through the keyboard 22. Accordingly, there has to be a mechanism to input signals produced by the keyboard 22 into the tablet unit 12. This is achieved, in one embodiment, by a flex cable 28 that carries power, signal, and ground lines from the keyboard 22 to the tablet unit 12. FIG. 1 of the drawings, indicates the position of the flex cable 28, in broken lines in accordance with one embodiment of the invention. The flex cable 28 is embodied within a sheath around the first panel 16, runs transversely across the flexible hinge 20, and is covered by a sheath material of the second panel 18 (see FIG. 1D of the drawings). The flex cable 28 ends in a socket connector 30 (see FIG. 1) which, in use, engages a complementary input port 32 of the tablet unit 12 (see FIGS. 4 and 5).

Figure 5:
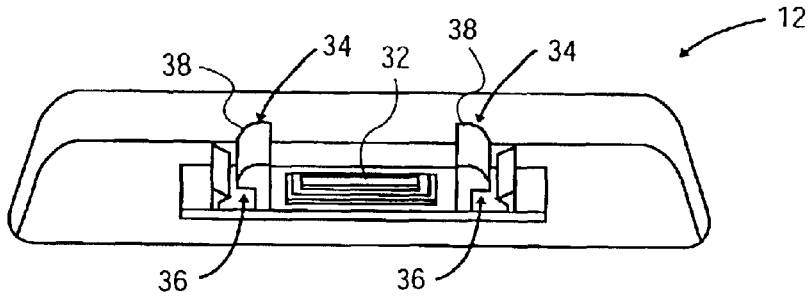
FIG. 5 is a perspective view showing a portion of the tablet unit of FIG. 4 in greater detail.

It will be appreciated that in order for the second panel 18 to function as a prop as shown in FIG. 2 of the drawings, the second panel 18 has to be mechanically secured to the base unit 14. Accordingly, in one embodiment of the invention, the system 10 has a releasable locking mechanism to releaseably lock the socket connector 30 to the input port 32 of the tablet unit 12. The releasable locking mechanism includes a pair of spaced-apart locking members 34 mounted adjacent the input port 32 of the tablet unit 12, on either side thereof, as can be seen in FIG. 5 of the drawings. Each locking member 34 has an undercut recess which results in an abutment surface 36 whose function is explained below. Further, an upper surface 38 of each locking member 34 is contoured to act as a camming surface as will be described below.

Figure 6A:
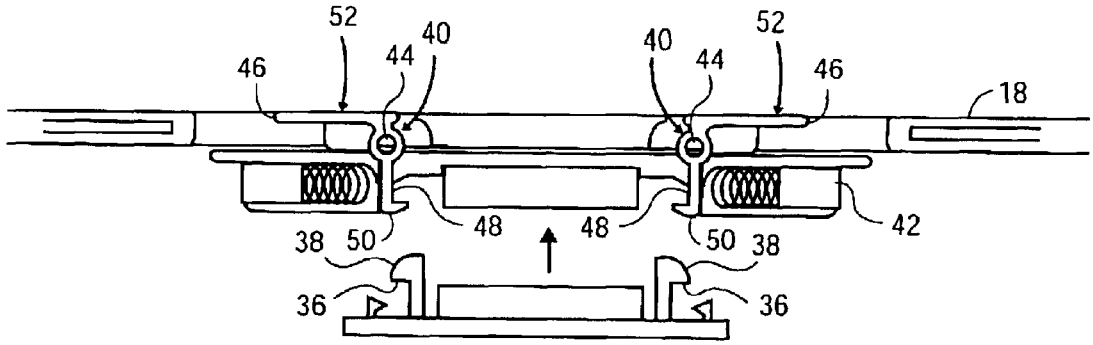
FIGS. 6A to 6C illustrate the operation of releasable locking mechanism of FIG. 4.
Figure 6B:
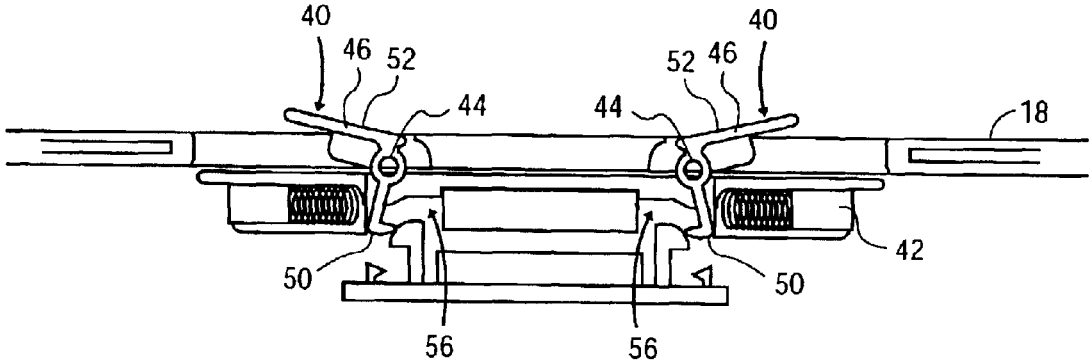
Figure 6C:
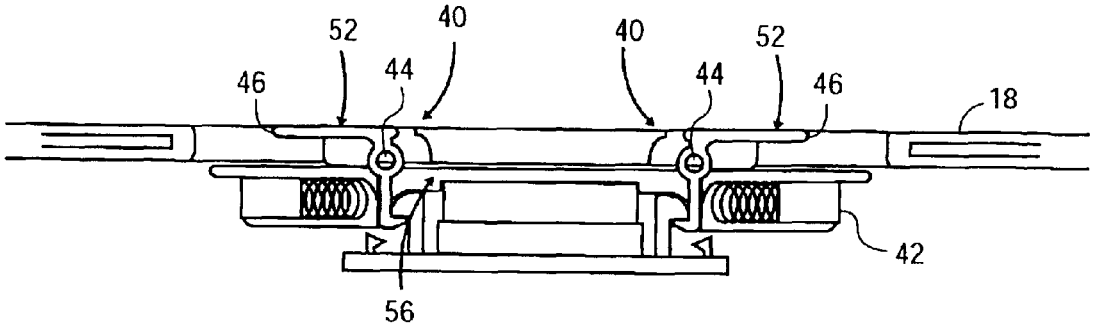

The releasable locking mechanism further includes a pair of catches in the form of two generally L-shaped levers 40 (see FIGS. 6A to 6C) pivotally mounted within a body 42 which is secured to the second panel 18 of the base unit 14 adjacent an edge thereof. In one embodiment, the levers 40 may be pivotally secured to the body 42 by pivot pins 44. Each of the levers 40 includes an effort arm 46, and a load arm 48. Each load arm 48 ends in a hook formation 50 that is shaped and dimensioned to engage the abutment surface 36 of a locking member 34. As will be seen in FIG. 6A, the levers 40 are counter-sunk within a recess so that an operatively upper surface 52 of each effort arm 46 is flush with the body 42. In order to realeaseably lock the levers 40 to the locking members 34, the second panel 18 of the base unit 14 is brought into contact with the tablet unit 12 so that the hook formation 50 of each lever 40 bears against the contoured surface 38 of each locking member 34. Each contoured surface 38 acts as a camming surface to guide the hook formations 50 into the undercut recess so that they engage the surfaces 36. When the hook formation 50 of each lever 40 is brought to bear against the surface 38 of each locking member 34, the lever 40 pivots against a biasing force exerted by a biasing element, which in one embodiment includes a spring 54 which exerts a biasing force that tends to urge the hook formations 50 together. This results in at least a portion of the effort arm 46 of each lever 40 extending from the body 42 as can be seen in FIG. 6B of the drawings. Extension of the lever 40 as described, allows a user to grip the levers 40 to squeeze the effort arms 46 towards each other, thereby to cause the hook formation 50 to be pivotally displaced away from each other to allow the locking members 34 to move into a space 56 between the levers 40. When the levers 40 are released, under influence of the biasing action of the springs 54, the levers 40 pivot towards each other causing the hook formations 50 to engage a respective one of the abutment surfaces 36 of each locking member 34 as shown in FIG. 5C of the drawings. In this position, the levers 40 are releaseably locked to the locking members 34 resulting in the second panel 18 of the base unit 14 being releaseably locked to the tablet unit 12. Thus, when in the laptop mode configuration, as shown in FIG. 2 of the drawings, the second panel 18 of the base unit 14 may be propped against the tablet unit 12 to support the tablet unit 12 at an inclined position so that it makes an angle $\alpha$ of greater than 90 degrees with the keyboard unit 22.

As explained above, the flexible hinge 20 allows articulation of the first panel 16 and relative to the second panel 18. In one embodiment, the hinge 20 comprises a woven layer 60 (see FIG. 7) which is fabricated using fibers of a first material, reinforced with pieces of a second material. In one case, the first material comprises polyester fibers 62, and the second material comprises strips 64 of aluminum. In the example shown in FIG. 6 of the drawings, the aluminum comprises four strips 64 of aluminum. However this number will vary depending on a desired flexibility of the hinge 20. As can be seen FIG. 6, a cable 66 which connects the keyboard 22 to the tablet unit 12 passes transversely through the hinge 20. In one embodiment the hinge 20 is sheathed with a suitable covering material 68 such as leather.

Figure 7:
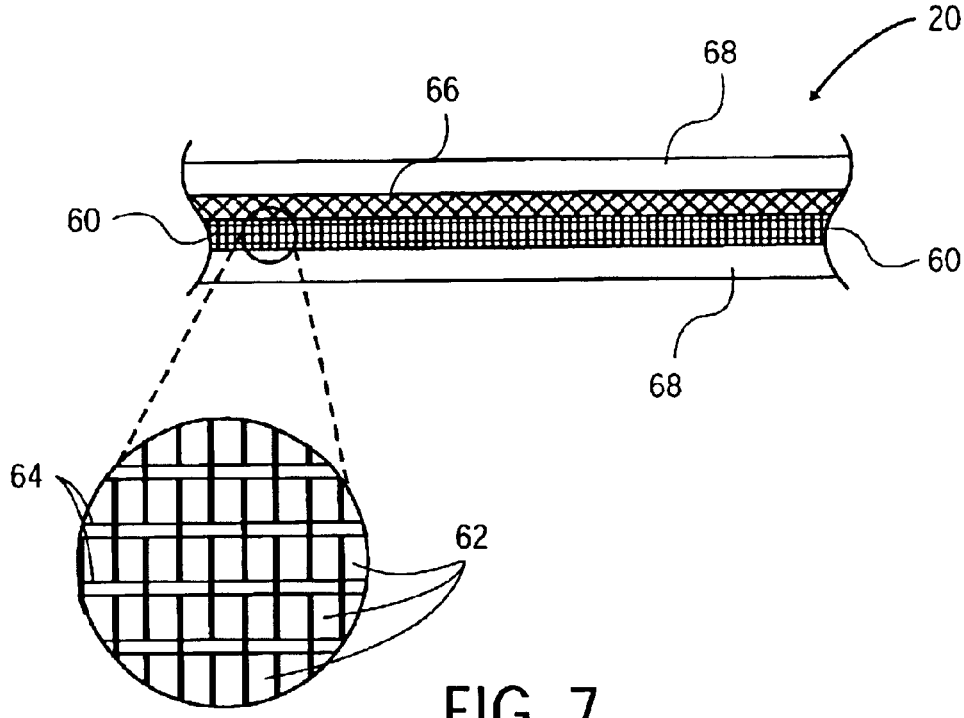
FIGS. 7 and 8 illustrate how a hinge of the system of FIGS. 1A to 1E may be fabricated, in accordance with different embodiments.
Figure 8:
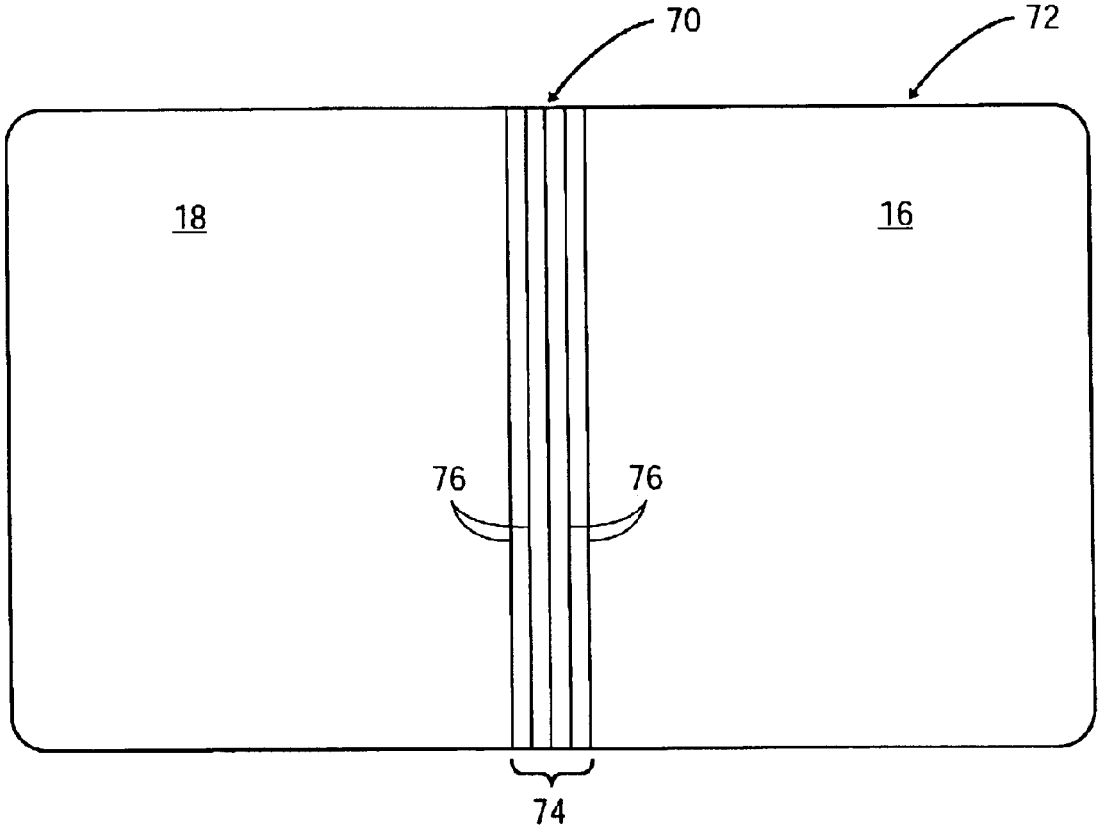

FIG. 7 of the drawings shows an alternative embodiment of the flexible hinge between the first and second panels 16, 18. In FIG. 7, the hinge is generally indicated by reference numeral 70. The first panel 16, and the second panel 18 form part of a single sheet material 72, and the hinge 70 is defined therein by a zone of weakness 74 between the first and second panels 16, 18. In one embodiment, the zone of weakness is formed by etching lines of weakness 76 in the sheet 72.

Although the present invention has been described with reference to specific exemplary embodiments, it will be evident that the various modification and changes can be made to these embodiments without departing from the broader spirit of the invention as set forth in the claims. Accordingly, the specification and drawings are to be regarded in an illustrative sense rather than in a restrictive sense.

What is claimed is:

1. A pen-based computing system comprising:

a tablet unit including a display screen and an input port;

a base unit including first and second generally planar members connected via a hinge, a keyboard supported on the first planar member, a socket connector disposed on the second planar member, electrical lines to carry signals from the keyboard to the socket connector; and a releasable locking mechanism to releaseably lock the socket connector to the input port.

2. The system of claim 1, wherein the releasable locking mechanism comprises a catch mounted on the base unit adjacent the socket connector, the catch being shaped and dimensioned to be releaseably locked to a complementary locking formation adjacent the input port.

3. The system of claim 2, wherein the catch comprises a pair of levers pivotally mounted to a body portion which is secured to the base unit, each lever having a hook formation at an end thereof.

4. The system of claim 3, wherein the locking formation comprises a pair of spaced apart locking members that stand proud of the tablet unit, each locking member having an undercut recess at an end remote form the tablet unit to define a sharp edge which is engageable by a respective one of the hook formations to releaseably lock the levers to the locking members.

5. The system of claim 4, wherein the end of each locking member remote from the tablet unit has a contoured surface matched to a profile of the hook formations, the contoured surface acting as a camming surface to guide a respective one of the hook formations into the undercut recess.

6. The system of claim 4, wherein the levers are biased towards each other.

7. The system of claim 4, wherein the levers are generally L-shaped comprising an effort arm shaped and dimensioned to be finger actuable, and a load arm that carries the hook formation.

8. The system of claim 7, wherein the levers are countersunk within recesses in the body portion so that an operatively upper surface of the effort arm is flush with the body portion.

9. The system of claim 8, wherein each lever pivots to raised position in which its effort arm extends from the body portion to facilitate access thereto when the hook formation of each lever bears against the contoured surface.

10. A base unit for a tablet personal computer, the base unit comprising:

a first panel including a keyboard;

a second panel adapted to form a support for a tablet unit of the tablet personal computer when in an inclined position; and a hinge connecting the first and second panels, wherein the hinge comprises a woven layer including fibers of a first material reinforced with pieces of a second material.

11. The base unit of claim 10, wherein the first material comprises polyester; and the second material is selected from the group consisting of aluminum, steel, and copper.

12. The base unit of claim 10, wherein the hinge further comprises a flexible cable extending transversely therethrough to carry electrical signals from the keyboard.

13. The base unit of claim 10, wherein the hinge is sheathed within a covering material.

14. A base unit for a tablet personal computer, the base unit comprising:

a first panel including the keyboard;

a second panel adapted to form a support for a tablet unit of the tablet personal computer when in an inclined position; and a zone of weakness defining a flexible hinge between the first and second panels.

15. The base unit of claim 14, wherein the first and second panels are defined by a single sheet of material, and the zone of weakness is defined by etching longitudinal channels in the single sheet of material.

16. A pen-based computing system comprising:

a tablet unit including a display screen;

a base unit comprising a first panel including a keyboard, a second panel adapted to form a support for the tablet unit at an inclined position relative to the base unit; and a hinge connecting the first and second panels, wherein the hinge comprises a woven layer including fibers of a first material reinforced with pieces of a second material.

17. The system of claim 16, wherein the first material comprises polyester, and the second material is selected from the group consisting of aluminum, steel, and copper.

18. A pen-based computing system, comprising:

a tablet unit including a display screen; and a base unit comprising a first panel including a keyboard, a second panel adapted to form a support for the tablet unit at an inclined position relative to the base unit, and a zone of weakness defining a flexible hinge between the first and second panels.

19. The system of claim 18, wherein the first and second panel are defined by a single sheet of material, and the zone of weakness comprises lines of weakness etched in the single sheet of material.

* * * * *